US006431477B1

(12) United States Patent
Pallmann

(10) Patent No.: US 6,431,477 B1
(45) Date of Patent: Aug. 13, 2002

(54) GAS FLOW-TYPE CHIPPING MACHINE

(75) Inventor: Wilhelm Pallmann, Zweibrücken (DE)

(73) Assignee: Pallmann Maschinenfabrik GmbH & Co. KG, Zweibrücken (DE)

( * ) Notice: Subject to any disclaimer, the term of this patent is extended or adjusted under 35 U.S.C. 154(b) by 0 days.

(21) Appl. No.: 09/421,667

(22) Filed: Oct. 20, 1999

(30) Foreign Application Priority Data

Oct. 20, 1998 (DE) ..... 198 48 233

(51) Int. Cl.[7] ..... B02C 13/286

(52) U.S. Cl. ..... 241/57; 241/86.1; 241/186.3; 241/248

(58) Field of Search ..... 241/86.1, 57, 248, 241/245, 186.3

(56) References Cited

U.S. PATENT DOCUMENTS 947,275 A * 1/1910 Bowsher ..... 241/248
1,975,406 A * 10/1934 Reschke ..... 241/248
4,066,215 A * 1/1978 Pujol ..... 241/46.11
4,087,052 A * 5/1978 Rohrbach ..... 241/63
4,998,678 A * 3/1991 Durr ..... 241/171
5,190,227 A * 3/1993 Pallman ..... 241/79.1
5,263,653 A * 11/1993 Pallman ..... 241/79.1
5,462,235 A * 10/1995 Driscoll et al. ..... 241/57
5,464,163 A * 11/1995 Zoz ..... 241/172
5,529,250 A * 6/1996 Pallmann ..... 241/57
6,073,867 A * 6/2000 Ferlez ..... 241/56

FOREIGN PATENT DOCUMENTS

DE 4316350 11/1994

* cited by examiner

*Primary Examiner*—Allen Ostrager
*Assistant Examiner*—William Hong
(74) *Attorney, Agent, or Firm*—Friedrich Kueffner

(57) ABSTRACT

A gas-flow type chipping machine with a rotating beater-wheel system. In order to chip the feed material, this material is delivered axially into the central area of the beater wheel, where it is deflected and moved in a radial direction to the chipper tools that are arranged in a circle around the beater wheel. In order to ensure that the wear is even along the length of the chipper tools, at least two impact surfaces are arranged so as to be axially staggered to the depth of the chipping space, the impact surface that follows in the axial direction of delivery projecting beyond the axial projection of the preceding impact surface. In addition to the foregoing, the present invention discloses a method for optimizing the size and position of the impact surfaces of a chipping machine according to the present invention.

14 Claims, 6 Drawing Sheets

GAS FLOW-TYPE CHIPPING MACHINE

BACKGROUND OF THE INVENTION

The present invention relates to a gas-flow type chipping machine with a rotating beater-wheel system and a method for optimizing such chipping machines.

A consequence of the constantly growing demand for wood chips to be used, for examples in manufacturing chip board, which is being voiced by the wood-processing industry, is that ever larger machines with greater throughput capacities are being built to produce the starting materials that are required to satisfy this demand. Recently, old wood that has been recovered by recycling has been used as the raw material for manufacturing wood chips. These developments are causing various problems that have been overcome with the aid of the present invention.

On the one hand, depending on the purpose for which it was previously used, old wood can contain a comparatively large quantity of impurities. In the case of construction lumber, these impurities are frequently in the form of traces of concrete and sand that have adhered to be wood, as well as nails and screws. DE 43 16 350 describes an effective way of removing such impurities from the feed material. To this end, an input apparatus in the form of a wind sifter is incorporated ahead of a chipping device. The feed material, previously cleaned by a magnetic drum and a sieve surface, is passed through a sifting channel in which relatively heavy particles are separated out. The transverse flow of air that performs the actual sifting also serves as the motive force that moves the feed material through a wide channel into the chipping area of the chipping machine. Chipping machines that are configured in this way achieve a high level of separation of foreign matter and deliver good chip quality, always providing that the material is sufficiently homogeneous with respect to size and density.

This cannot always be assured when old wood is reused, when different types of wood of various densities are mixed so that the chipping knives that extend to the full depth of the chipping area are not acted upon uniformly to their total length. Rather, there are zones in which the more material collects, with the result that more chipping work has to be done. The result is greatly increased localized wear that leads to the need for premature replacement of the blades and thus to shorter machine run times.

This undesirable effect is also exacerbated by the design of powerful machines with deeper chipping areas, in which it is, of course, more difficult to ensure that the length of the blades can be acted upon uniformly because they are so long.

Certainly, DE-OS 224 37 202 and DE-PS 26 01 384 describe measures to ensure that the blades are acted upon in a uniform manner. However, because of the fundamentally different ways of delivering the feed material into the chipping area, these cannot of necessity be transferred to the present invention. In the cases of both OS 24 37 202 and DE-PS 26 01 384, the Reed material passes through an inclined entry chute by gravity, and then enters the chipping area at its centre. In the case of OS 24 37 202, the entry chute is divided into a plurality of tracks that extend to varying distances into the interior of the chipping area. At the end of each track there is an impact plate that diverts the flow of material to the chipping tools into a radial direction. Because of the arrangement of the impact plate, which are staggered to the depth of the chipping area, the material is distributed evenly to the depth of the chipping area.

In the case of DE-OS 26 01 384, at its machine end, the fixed entry chute becomes a rotating truncated cone within which there is a similarly rotating distributing device. The distributing device consists essentially of three circular sectors that are staggered to the depth of the chipping area and are separated by bulkheads; diametrically opposed cutouts in the outer surface of the truncated cone are associated with these circular sectors. The feed material is delivered to specific areas of the chipping tools through the cutouts in the outer surface.

It is true that these known devices that ensure that the chipping tools are acted upon evenly to the whole length function work well in the case of chipping machines with an entry for the material by way of a chute, and if the feed material is homogeneous; however, as a result of design and construction constraints they cannot be used in conjunction with a chipping machine that has a pneumatic charging system that is preferably combined with a previous wind-sifting system. Whereas the entry chute controls the feed material at low speeds and guides it to a predetermined point in the chipping area, in the case of pneumatic charging that is effected with the aid of the flow of air, the feed material is injected into the chipping area at high speed. Measures that belong to the prior art cannot accommodate the feed material that arrives with a great deal of kinetic energy from a predetermined direction, and then deliver it to the chipping tools.

SUMMARY OF THE INVENTION

Against this background, it is the objective of the present invention to describe a gas-flow type chipping machine in which the charging is effected pneumatically and in which the chipping tools are acted upon uniformly to their whole length.

According to the present invention, this objective has been achieved by a chipping machine, wherein, in order to ensure that the feed material is evenly distributed to the length of the chipper tools, there are at least two impact surfaces that are arranged in the chipping area so as to be axially staggered by depth, the impact surface that follows in the axial direction of delivery projecting beyond the axial projection of the preceding impact surface.

It is a further objective of the present invention to describe a method for optimizing the position and dimensions of the impact surfaces according to the present invention.

This objective has been achieved by a method with the following steps: a) the wear on the chipping tools at specific positions prior to operation is determined; b) the machine is operated for a specific amount of time; c) the wear on the chipping tools at the places identified in a) is determined; the diameter and/or spacing of the impact surfaces is varied in the event that the wear on the chipping tools is not constant at the locations identified in a); the steps a) to d) are repeated until such time as the wear on the chipping tools is constant at the locations identified in a).

According to the present invention, the feed material is deflected radially on impact surfaces that are arranged at different depths, as a function of the eccentricity of the projections on which the feed material moves into the chipping machine. In this way, a radial material track can be associated with each axial trajectory, each of said tracks leading to one specific sector of the drum-like chipping track. Only by creating conditions that are so defined can the way in which the chipping tools are acted upon to their whole length be controlled by changing parameters such as the position and/or dimensions of the impact surfaces. Because of this it is possible to introduce inhomogeneous material into a chipping machine according to the present invention, or increase the depth of the chipping area in order to increase the throughput rate. Although—in the past—this resulted in great costs because of locally increased wear on the chipping tools, now the chipping tools themselves are worn evenly to their whole lengths under such conditions, so that the interval between tool changes have become longer, and machine run time is correspondingly longer, with the result that overall economy has been enhanced.

The chipping machines according to the present invention are particularly advantageous in the case of new investment. Because of the specific and even distribution of the feed material to the whole depth of the chipping area, the present invention makes it possible to build chipping machines of large dimensions with deep chipping areas. This means that machines that are not so large deliver equal throughput performance, so that the costs for foundations, electrical connections, and delivery systems are reduced.

In one particular embodiment, the present invention has rotating impact surfaces that in the case of a similarly rotating circular blade set can advantageously be driven independently of this. This means that the feed material is not only deflected through 90° at the impact surfaces, but is simultaneously accelerated in a radial direction, as well.

Configuring the impact surfaces as rotationally symmetrical bodies such as circles, annular rings, or truncated cones prevents excessive wear on the impact surfaces, since the working areas of the impact surfaces are minimized in this way and it promotes orderly flow conditions within the chipping area.

Whereas in the case of impact surfaces with enclosed surfaces, the feed material that is entering axially crosses the trajectories of the deflected feed material, thereby causing collisions that have an adverse effect on orderly flow conditions within the chipping area, one especially advantageous embodiment of the present invention makes crossing-free guidance of the feed material possible. According, to this, because of a central opening, the impact surfaces are in the form of an annular ring. The annular surface of these impact surfaces can also be inclined, which results in a hollow truncated cone. In this way, the present invention is adapted to beater wheels in which the beater-wheel seat extends into the chipping area. This embodiment also entails the advantage that the feed material does not strike the impact surface at a right angle and is thereby deflected into a radial direction that reduces wear.

The fact that the impact surfaces can be displaced in the axial direction makes it possible to optimize the impact surfaces in order to achieve even wear on the chipping tools. Proceeding from the basic adjustment with the diameter of the impact surface being 1/10 to 1/3 of the diameter of the beater wheel or the impact surfaces being arranged so as to be spaced apart at a constant distance form each other, optimization takes place in that a) the wear on the chipping tools at specific positions prior to operation is determined; b) the machine is operated for a specific amount of time; c) the wear on the chipping tools at the places identified in a) is determined; the diameter and/or spacing of the impact surfaces is varied in the event that the wear on the chipping tools is not constant at the locations identified in a); the steps a) to d) are repeated until such time as the wear on the chipping tools is constant at the locations identified in a). The advantage of such a procedure is that all borderline conditions are taking into account, as are such influences that would be too complex for a theoretical investigation.

The rectangular configuration of the entry opening that, even in the case of a comparatively low height, extends to the width of the overall inside diameter of the beater wheel ensures that the feed material strikes all the impact surfaces in equal quantities, so that it is evenly distributed to the depth of the chipping area. In addition, the flow of air generated for wind sifting can be used for pneumatic delivery of the feed material without any significant deflection, so that its energy can be exploited to the fullest possible extent.

By using guide panels, the width of the entry opening can be divided in several segments that preferably correspond to the axial material tracks.

BRIEF DESCRIPTION OF THE DRAWINGS

The present invention will be described in greater detail on the basis of an embodiment shown in the drawings appended hereto. These drawings show the following.

DESCRIPTION OF PREFERRED EMBODIMENTS

Figure 1:
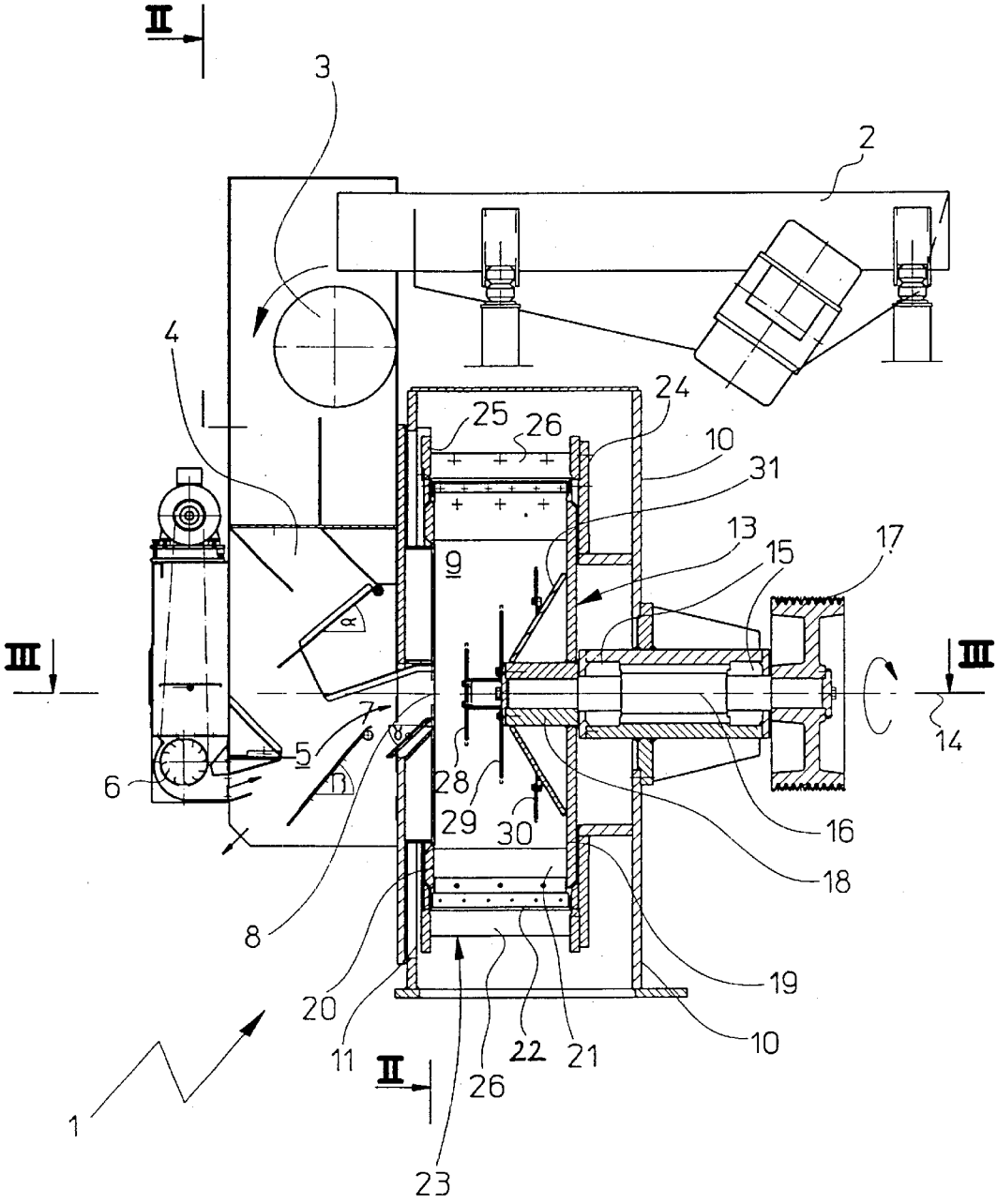
FIG. 1: a vertical cross section through a first embodiment of a chipping machine according to the present invention, on the line I—I shown in FIG. 2.
Figure 2:
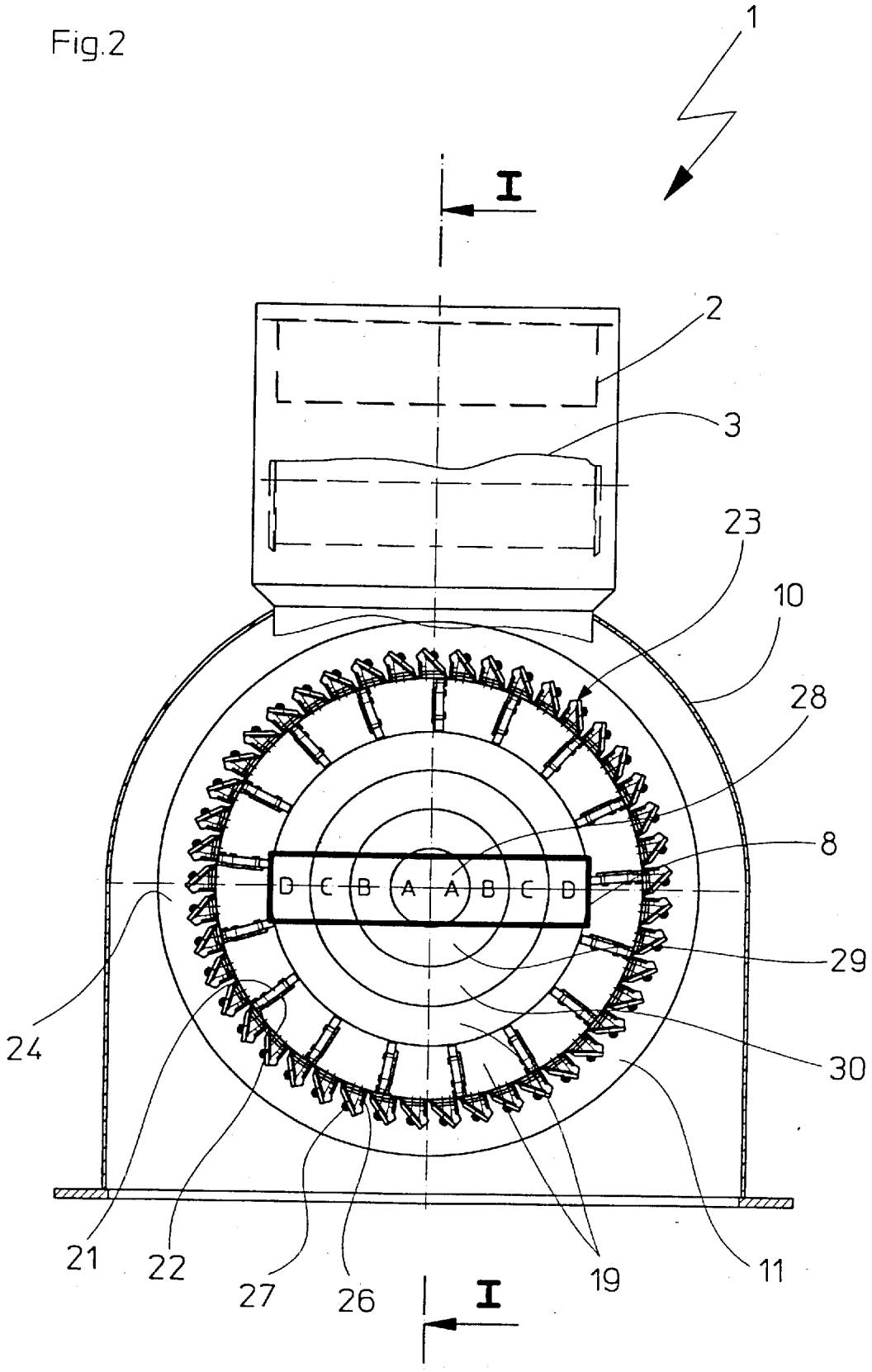
FIG. 2: a cross section through the chipping machine, along the line II—II shown in FIG. 1.

FIG. 1 and FIG. 2 show a chipping machine according to the present invention; this is in the form of a chopper-type chipper 1 that is shown with the complete conveyor and separating system. The conveyor and separating system includes a vibrating trough 2 that separates the flow of material by size and weight during the conveying process. In order that bits and pieces of iron can be removed from it, the feed material is passed over a magnetic drum 3, from where it moves into a drop shaft 4 with elements in the form of a cascade. The lower part of the fall shaft 4 incorporates a sifting passage 5. A cross-flow blower 6 that is arranged on the front side of the fall shaft 4 generates the flow of air that is required, and it simultaneously blows the feed material through an air and material entry channel 7 and finally through an entry opening 8, axially into the central area of the chipping area 9 of the chopper-type chipper 1.

The chopper-type chipper 1 according to the present invention has a drum-like housing 10, the front side of which incorporates a central circular opening 11 that can be closed off by a pivoting housing cover 12. The above-described housing cover with the integrated wind-sifting system is secured to the outer side of the housing cover 12 in such a way that it can pivot with it.

Within the chopper-type chipper 1 there is a beater wheel 13 that is supported on a shaft 14 so as to be able to rotate freely. The beater wheel 13 incorporates a horizontal drive shaft 16 that extends through the rear wall of the housing 10 and is supported in the bearings 15. The end of this that is outside the housing 10 supports a multi-grooved pulley 17 that is connected by a notched belts to an electric motor (not shown herein). At the end of the drive shaft 16 that is within the chipping area 9 there is a hollow-cylindrical seat 18 on which is secured a carrier disk 19 that is arranged coaxially to the shaft 14. At a distance that corresponds to the length of the cutter tools, the carrier disk 19 is space apart from and opposite an annular disk 20 that is adjacent to an inclined face on the inside of the housing cover 12 with its inside periphery spaced apart therefrom so as to leave a small gap. Axially arranged impact plate carriers 21 with impact plates 22 secured thereon, which are distributed evenly around the outside periphery of carrier disk 19, connect the barrier disk 19 to the annular disk and thereby impart rigidity to the beater wheel 13.

The beater wheel 13 is surrounded concentrically by a cutter wheel 23 that rotates relatively to it and is separated from it by an annular gap. The cutter ring 23, like the beater wheel 13, is formed from two annular disks 24 and 25 that are arranged so as to be spaced apart, and these have the blade carriers 26 arranged around their peripheries; the actual cutting tools, in the form of blades 27, are secured to these blade carriers 26 (FIG. 2).

A deflector system in the form of impact disks 28, 29, and 30, which is needed to en ure the even distribution of the feed material to the full depth of the chipping area 9, is arranged in the central area of the beater wheel 13 that is surrounded by the beater plate carriers 21. The impact disk 28 is circular and is connected concentrically to the drive shaft 16; it is arranged so as to be directly opposite the entry opening 8 and covers the central area of this opening. Offset from the impact disk 28 and spaced apart from it axially in the direction of the carrier disk 19 there is another concentric impact disk 29 that is also secured to the drive shaft 16. This impact disk 29 is also circular, and its diameter is greater than that of the impact disk 28. This means that the outer periphery of the impact disk 29 projects beyond the axial projection of the impact disk 28. Finally, spiced further apart from the impact disk 29 and next to the carrier disk 19 there is another impact disk 30 in the form of an annular ring on the outer surface of a hollow truncated cone formed by the seat 18, the carrier disk 19, and an inclined surface 31. The outer periphery of the impact disk 30 also extends beyond the axial projection of the impact disk 29. The carrier disk 19 itself also serves as the impact disk that is located furthest within the interior of the chipping area 9; its surface extends beyond the axial projection of the impact disk 30 and reaches as far as the impact plate carrier 21.

Figure 3:
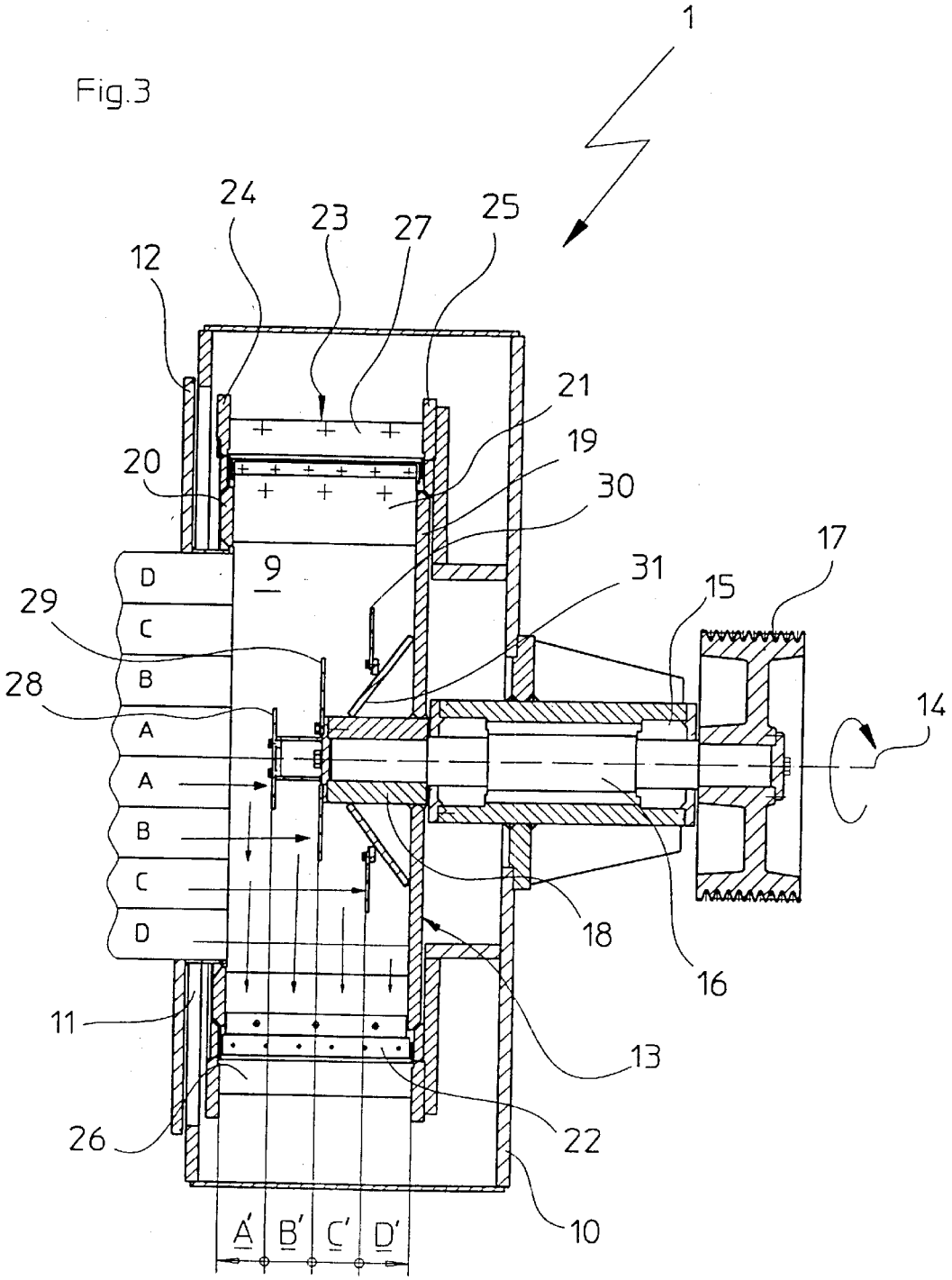
FIG. 3: a horizontal cross section through the chipping machine shown in FIG. 1, along the line III—III shown in FIG. 1, which also shows the flow conditions.

The annular surfaces of the individual impact disks 28, 29, and 30, and the carrier disk 19 that also serves as an impact disk, which extend beyond the axial projection, are shown in FIG. 2, in which they are identified by the letters A, B, C, and D. These annular surfaces lie centrally opposite the entry opening 8 in a staggered arrangement, with the width of the entry opening 8 corresponding approximately to the outside diameter of the annular surface D. In this way, as is shown in FIG. 3, the annular surfaces A, B. C, and D defined axial material tracks A, B, C, and D on which the feed material moves through the entry opening 8 to the impact disks 28, 29, and 30 and to the carrier disk 19 that also serves as a impact disk.

The material tracks, A', B', C', and D' are established in the radial direction by the planes defined by the individual impact disks 28, 29, and 30, and the carrier disk 19 that serves as an impact disk, and these divide the central area of the beater wheel 13 to a depth that corresponds to the length of the blades 27.

The amount of horizontal eccentricity of the trajectory of the feed material determines the impact surface A–D on which it lands and thereby how far it moves into the interior of the chipping area 9 before it is deflected onto one of the radial material tracks A' to D'.

In FIG. 3, an arrow indicates the path followed by the individual pieces of wood in the feed material through the chopper-type chipper 1. Because of the small amount of eccentricity relative to the shaft 14, a piece of wood on material track A lands on the impact surface A of the impact disk 28 that is closest to the entry opening B. At this point, the piece of wood is deflected by 90° onto the radial grinding track A' and it is accelerated because of the rotation of the impact disk 28. Finally, on the material track A', it is fed to the chipping tools because of the flow of air generated by the beater wheel. Because of its greater eccentricity, a piece of wood on the axial material track B flies past the impact disk 28 on to the impact surface B of the impact disk 29 that is located deeper within the chipping area 9. When this happens, it must cross the radial material track A' which, under certain circumstances, can cause different pieces of wood to collide. On the impact disk 29, the piece of wood is deflected into the radial material track B', This also applies to pieces of wood on the axial material tracks C and D, when the probability that pieces of wood moving axially will hit pieces of wood moving radially increases as the eccentricity of the pieces of wood increases.

Figure 4:
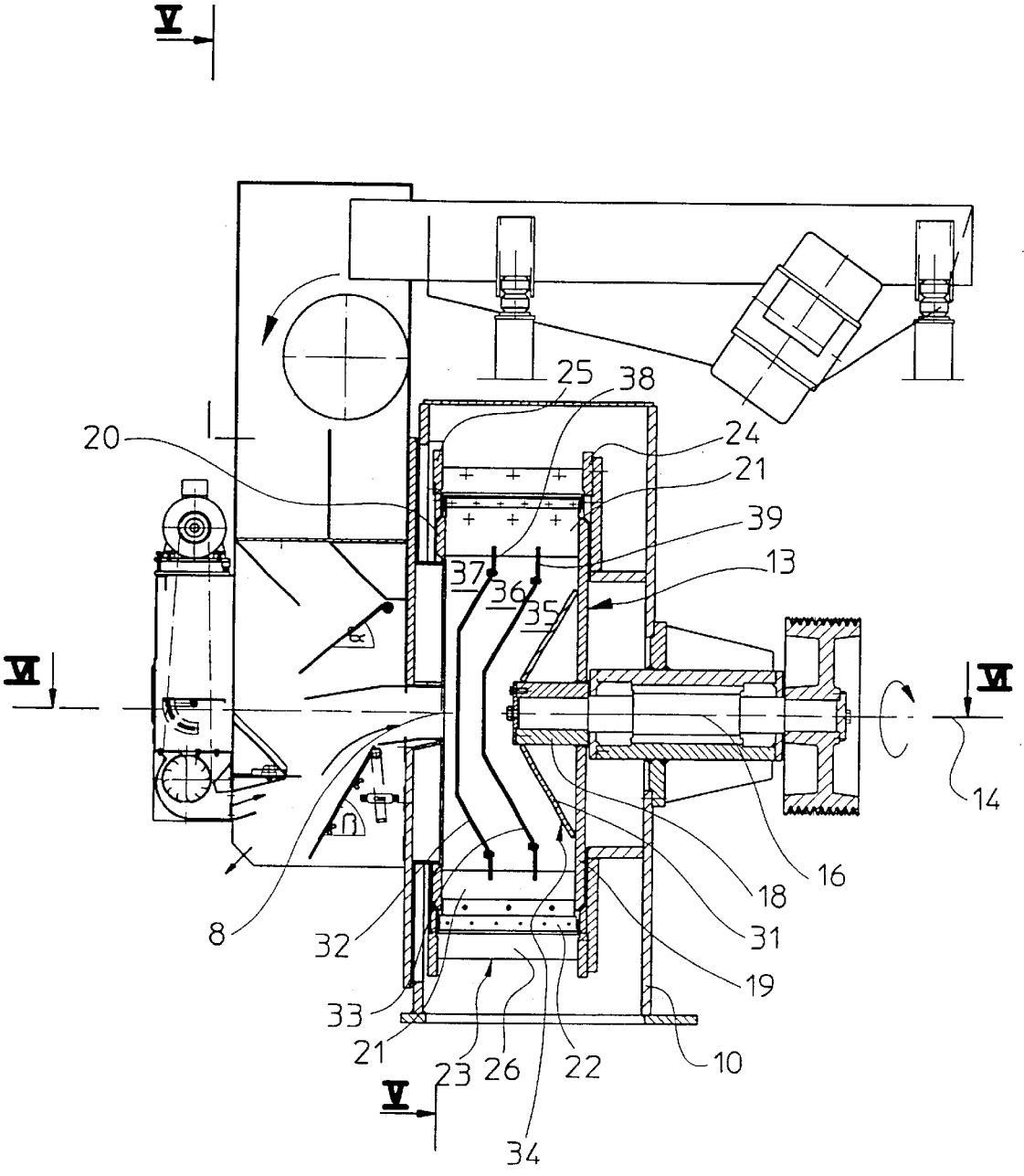
FIG. 4: a vertical cross section through another embodiment of a chipping machine according to the present invention, along the line IV—IV shown in FIG. 5.
Figure 5:
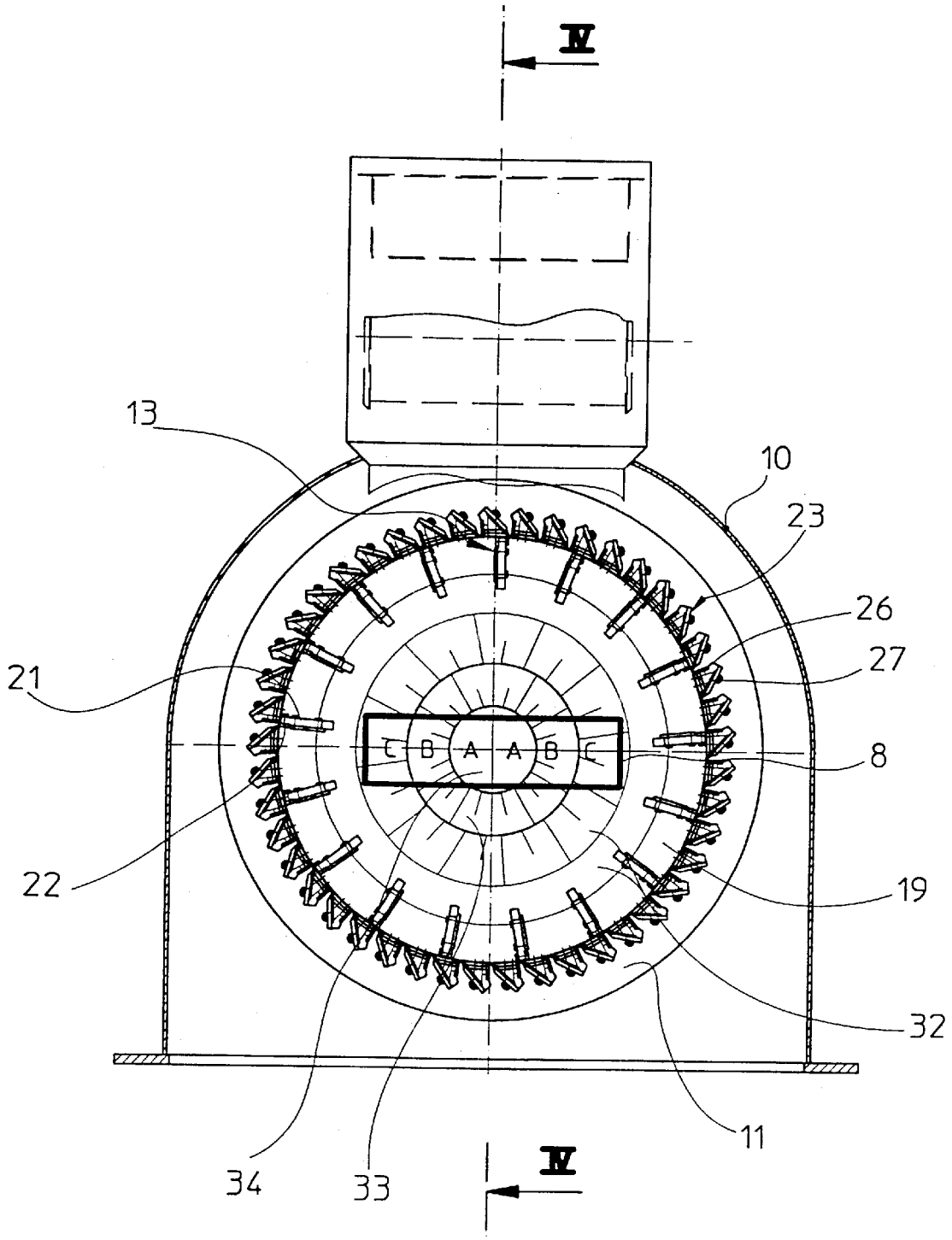
FIG. 5: a cross section through the chipping machine shown in FIG. 4, along the line V—V shown in FIG. 4.
Figure 6:
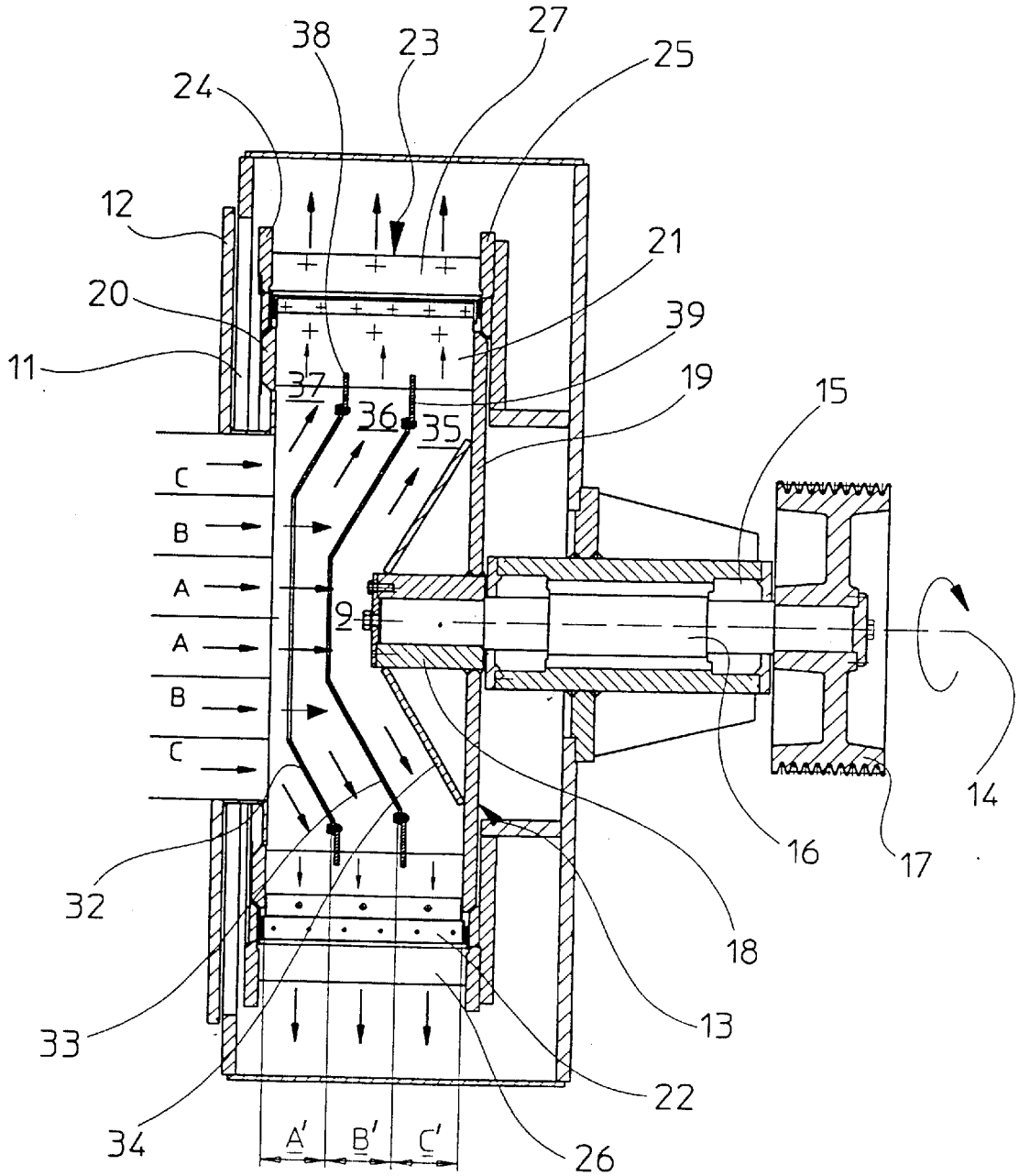
FIG. 6: a horizontal cross section through the chipping machine shown in FIG. 4, along the line VI—VI shown in FIG. 4, which also shows the flow conditions.

FIGS. 4 to 6 show another embodiment of a chopper-type wood chipper according to the present invention that guides the feed material through the central area of the beater wheel 13 without any collisions. FIGS. 4, 5, and 6 correspond to FIGS. 1, 2, and 3, so that the explanations associated with the latter apply. For purposes of simplification, identical parts bear identical reference numbers.

Unlike the embodiments shown in FIGS. 1 to 3, the deflection system in the centre of the chipping area 9 does not consist of a plurality of circular disks that are staggered by depth, the diameter of which increases the deeper they are arranged in the interior of the chipping area 9. Rather, the deflection system is formed from circular disks that are secured coaxially to the shaft 14 with their outer peripheries on the impact plates carriers 21 and which incorporate a central circular opening, the inside diameter of which decreases the deeper the arrangement is located within the chipping area 9.

In addition, in the embodiment shown in FIG. 4, the annular surface of the impact disk is inclined relative to the direction of delivery, so that in this case the deflection system consists essentially of the hollow truncated cones 32 and 33 that are arranged one behind the other and which grow wider in the direction of delivery. In order to secure the hollow truncated cones 32 and 33, the annular disks 38 and 39 are arranged on the inside of the impact plates carriers 21; the hollow truncated cones 32 and 33 are secured by their outer peripheries to the inner peripheries of these. An additional concentric hollow truncated cone 32 is formed by the seat 18, the carrier disk 19, and the inclined surface 31.

The channels 35 and 36 are formed by the arrangement of the truncated cones 32 and 33, in which they fit part way into one another whilst leaving some axial space, and together with the channel 37 that is formed by the truncated cone 32 and the annular disk 20, these divide the chipping area 9 evenly into the areas A', B', and C' (FIG. 6)

The impact surfaces A, B, and C that are shown in FIG. 5 are arranged so as to be centrally opposite the entry opening 8. The impact surface A is formed by the face end of the drive shaft 16 and of the seat 18 that is readily accessible for the feed material through the central openings in the truncated cones 33 and 33. The impact surface B results from the difference of the diameters of the central openings in the hollow truncated cones 32 and 33. Since the hollow truncated cone 32 has a central opening that is of greater diameter than that in the truncated hollow truncated cone 33, part of the outside surface of the hollow truncated cone 33, which represents the impact surface B, projects beyond the radial projection of the truncated hollow truncated cone 32. Finally, the impact surface C is formed from that part of the truncated hollow truncated cone 32 that is directly opposite the entry opening 8.

FIGS. 6 shows the axial material tracks A, B, and C that divide the entry opening 8 and which are associated with the impact surfaces A, B, and C, and on which the feed material moves into the chipping area 9 as indicated by the arrows. In this embodiment, too, the amount of eccentricity of the material track from the axis 14 determines how far a piece of wood is guided into the chipping area 9, i.e., on which material tracks A', B', C' it moves to the chipper toils.

In contrast to the embodiment that is described on the basis of FIG. 1 to FIG. 3, a piece of wood on the axial material track A moves to the impact surface A that is arranged furthest within the chipping area 9 and is deflected into a radial direction in the inclined channel 35 through which it finally moves to the chipping tools. A piece of wood on the axial material track B strikes the inclined impact surface B formed by the truncated hollow cone 33 that passes it to the inclined channel 36 and, at a greater eccentricity, a piece of wood on the axial material track C enters the chipping area 9 strikes the impact surface C of the hollow truncated cone 32 and moves through the inclined channel 37 to the chipping tools.

The advantage of this embodiment is seen in the guidance of the feed material through the chipping area 9 without any crossing, which means that individual pieces of wood do not collide; this results in constantly even distribution of the feed material along the length of the chipping tools.

What is claimed is:

1. A gas-flow type chipping machine with a rotating beater-wheel system comprising chipper tools (22, 27), in which a feed material is moved pneumatically in an axial direction into a central area of the beater wheel (13) and deflected in a radial direction to the chipper tools (22, 27) that are arranged in a circle around the beater wheel, wherein in order to ensure that the feed material is evenly distributed to a length of the chipper tools (22, 27) there are at least two impact surfaces (A, B, C, D) that are arranged in a chipping area (9) of the chipping machine so as to be axially staggered by depth, the impact surface that follows in the axial direction of delivery of the feed material projecting beyond the axial projection of the preceding impact surface.

2. A gas-flow type chipping machine as defined in claim 1, wherein the impact surfaces (A, B, C, D) are arranged so as to be concentric.

3. A gas-flow type chipping machine as defined in claim 1, wherein the impact surfaces (A, B, C, D) are supported so as to be able to rotate freely and are connected to a drive system.

4. A gas-flow type chipping machine as defined in claim 1, wherein at least one impact surface (A) is circular.

5. A gas-flow type chipping machine as defined in claim 4, wherein the diameter of the impact surface (A) is 1/10 to 1/3 of the diameter of the beater wheel (13).

6. A gas-flow type chipping machine as defined in claim 1, wherein at least one of the impact surfaces is annular.

7. A gas-flow type chipping machine as defined in claim 6, wherein the inside diameter of the annular impact surface that follows in the axial direction of delivery is smaller than the inside diameter of the preceding annular impact surfaces.

8. A gas-flow type chipping machine as defined in claim 6, wherein the impact surfaces that are of annular shape are arranged on a hollow truncated cone that is arranged so as to be coaxial on the beater wheel.

9. A gas-flow type chipping machine as defined in claim 6, wherein the impact surfaces (A, B, C, D) are configured as hollow truncated cones.

10. A gas-flow type chipping machine as defined in claim 1, wherein, in order to vary the spacing between the impact surfaces, the impact surfaces are supported so as to be movable in an axial direction.

11. A gas-flow type chipping machine as defined in claim 1, wherein the impact surfaces (A, B, C, D) are arranged so as to be spaced apart at a constant distance from each other.

12. A gas-flow type chipping machine as defined in claim 1, wherein entry opening (8) is configured so as to be rectangular.

13. A gas-flow type chipping machine as defined in claim 12, wherein the width of the entry opening (8) is approximately the same as an inside diameter of the beater wheel (13).

14. A gas-flow type chipping machine as defined in claim 12, wherein the height of the entry opening (8) is approximately 1/5 to 1/2 of a width of the entry opening (8).

* * * * *